US007377008B2

(12) United States Patent
Park et al.

(10) Patent No.: US 7,377,008 B2
(45) Date of Patent: May 27, 2008

(54) MULTIFUNCTION VACUUM CLEANER

(75) Inventors: Jung-seon Park, Gwangju (KR); Il-Won Yang, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 623 days.

(21) Appl. No.: 10/674,187

(22) Filed: Sep. 29, 2003

(65) Prior Publication Data

US 2004/0261212 A1 Dec. 30, 2004

(30) Foreign Application Priority Data

Jun. 26, 2003 (KR) ..... 10-2003-0042058

(51) Int. Cl.
*A47L 5/30* (2006.01)

(52) U.S. Cl. ..... 15/329; 15/323; 15/334; 15/331

(58) Field of Classification Search ..... 15/326, 15/328–329, 323, DIG. 10, 331, 352–353, 15/334; 55/DIG. 3
See application file for complete search history.

(56) References Cited

U.S. PATENT DOCUMENTS 5,145,499 A * 9/1992 Dyson ..... 55/337
5,524,321 A 6/1996 Weaver et al.
5,715,566 A 2/1998 Weaver et al.
5,935,279 A * 8/1999 Kilstrom ..... 55/337
6,607,572 B2 8/2003 Gammack et al.
6,735,818 B2 * 5/2004 Hamada et al. ..... 15/410
D493,926 S * 8/2004 Downey et al. ..... D32/31
6,839,934 B2 * 1/2005 Houghton et al. ..... 15/329
6,859,975 B2 * 3/2005 Ohta et al. ..... 15/347
2002/0162188 A1 * 11/2002 Harmen ..... 15/353

FOREIGN PATENT DOCUMENTS

GB 2372468 8/2002
WO WO94/17716 8/1994

* cited by examiner

*Primary Examiner*—Laura C Guidotti
(74) *Attorney, Agent, or Firm*—Ladas & Parry LLP

(57) ABSTRACT

A multifunction vacuum cleaner, in which a main body is removably connected to a frame portion, comprises a nozzle assembly for suctioning in an air including dusts or dirt on a cleaning area, a main body having a cyclone dust collector for centrifugally separating the dusts or dirt from the sucked air, a dust receptacle for collecting the separated dusts or dirt, a main body frame having an upper casing and a lower casing, a button operation portion formed on an upper part of the main body frame, and a connecting projection integrally formed with the button operation portion and moving elastically, and a frame portion which is pivotably connected with the nozzle assembly, and having a connecting groove to correspond to the connecting projection. The main body of the vacuum cleaner is removably mounted in the frame portion. As a result, the main body can be conveniently connected with or separate from the frame portion.

15 Claims, 5 Drawing Sheets

MULTIFUNCTION VACUUM CLEANER

BACKGROUND OF THE INVENTION

1. Field of the Invention

The present invention relates generally to a vacuum cleaner, and more particularly, to a vacuum cleaner for multi purpose use in which the main body of the cleaner is removably mounted in the frame portion.

2. Description of the Related Art

A general upright vacuum cleaner cleans a wide area such as a floor or a carpet, by forcibly suctioning dust and dirt entrained within air that is drawn in by suction force generated inside the main body of the vacuum cleaner.

As shown in FIG. 1, a general conventional vacuum cleaner comprises a nozzle assembly 12 mounted in the bottom part of the main body 11 of the vacuum cleaner to move along an area to be cleaned, such as a floor or carpet. Inside the main body 11, an upper part comprising a dust collecting chamber (not shown) includes a dust bag (not shown in FIG. 1), and a lower part includes a motor driving chamber 30 where a motor is mounted. The dust collecting chamber is shut by a dust cover 10, as shown.

Above the main body 11 is mounted a handle portion 13 for pushing or pulling the vacuum cleaner, including the nozzle assembly 12 over the surface to be cleaned. On one side of the main body 11, an on/off switch 15 is disposed.

In the above structure, when the motor is driven by manipulation of the on/off switch 15, a strong suction force is generated in the nozzle assembly 12, and thereby air, including entrained dust and dirt, is removed from the area to be cleaned around the nozzle assembly 12 and is suctioned into the main body 11.

The air drawn into the nozzle 12 passes through the dust bag in the dust collecting chamber of the main body 11 and the motor driving chamber 30, through a grill unit mounted between the dust collecting chamber and the motor driving chamber 30. Here, the dust entrained in the air is collected in the dust bag, and the air is discharged to the outside through a discharging grill 40, after passing through the motor driving chamber 30.

After the cleaning work has been completed, if the dust collecting chamber becomes filled with a predetermined amount of dust, a user can separate the dust cover 10 and replace the full dust bag with a new dust bag to continue use of the vacuum cleaner.

However, the above-described structure of a general upright vacuum cleaner has several problems, such as the following.

General upright vacuum cleaners are usually used for cleaning a wide area such as a floor or a carpet. Therefore, when the area to be cleaned is narrow or has obstacles, such as a projection or a doorsill, conventional upright vacuum cleaners are inefficient to use.

Further, the main body portion of general conventional upright vacuum cleaners is not removable. As a result, upright vacuum cleaners comprising an integral dust collector are somewhat bulky.

Still further, for cleaning a narrow area or an area having obstacles, a user needs to additionally prepare and have ready a variety of auxiliary brushes or accessories for a vacuum cleaner, or is required to buy a separate small vacuum cleaner, which becomes quite uneconomical.

SUMMARY OF THE INVENTION

It is an object of the present invention to provide a vacuum cleaner for multifunction use to overcome the above problems, of which the main body of the cleaner is removably mounted in the frame portion.

Another object of the present invention is to provide a multifunction vacuum cleaner of an improved structure, of which the main body of the cleaner is easy to attach to or separate from the frame portion.

Yet another object of the present invention is to provide a multifunction vacuum cleaner which is compact and economical.

In order to achieve the above-described objects, there is provided a multifunction vacuum cleaner according to the present invention, which is removably connected to a frame portion, and comprises a nozzle assembly for drawing in air, including entrained dust or dirt, from as area or surface to be cleaned, a main body having a cyclone dust collector for centrifugally separating the dust or dirt from the air drawn into the cyclone dust collector, a dust receptacle for collecting the separated dusts or dirt, a main body frame having an upper casing and a lower casing, a button operation portion formed on an upper part of the main body frame, and a connecting projection, integrally formed with the button operation portion, capable of moving together with the button operation portion, and a frame portion pivotably connected with the nozzle assembly, and having a connecting groove capable of receiving the connecting projection therein.

The button operation portion further comprises a button operation portion body which is essentially semicircular, a biasing member for biasing the button operation portion body toward a desired position, a pressing button integrally formed with the button operation portion body at a top part thereof, and a guide extended from one side of the button operation portion.

The main body frame comprises a biasing member supporting portion for supporting the biasing member, a guide groove for guiding movement of the guide, and an opening through which the connecting projection protrudes, whereby the button operation portion moves in the main body as the pressing button of the button operation portion is depressed.

Additionally, the main body preferably comprises a handle portion allowing a user to grab on the upper part, and the handle portion is shaped to correspond to the shape of the button operation portion and has a hollow portion therein.

Here, it is preferable that the main body comprises on one of its sides, a first rotatable cord holder for winding therearound and holding a power cord of the vacuum cleaner, and a stationary second cord holder formed at a predetermined distance from the first cord holder. Further, the main body comprises a communicating member disposed at a bottom part of the main body for fluidly communicating with the nozzle assembly.

In addition, it is also preferable that the main body further comprises a flexible hose capable of being connected to the communicating member, a hose supporting member for supporting the flexible hose, and a discharging grill through which the clean air is discharged. It is preferable that the flexible hose is removably connected to the communicating member, and when removed, capable of being connected with an auxiliary accessory on one end thereof.

In addition, it is preferable that the main body comprises an on/off switch located at a front side of the main body, and the frame portion has at least one supporter formed on at least one side thereof to provide support to the main body when it is mounted therein. Here, each supporter may include a mounting guide on one side of the supporter for the mounting of accessories for use with the vacuum cleaner.

The connecting groove preferably has a slanted part for easier insertion of the main body into the frame portion. It is preferable that the frame portion comprises wheels on both sides of the bottom thereof, which are disposed for use with the frame portion to permit easier motion of the vacuum cleaner over the area or surface to be cleaned.

The frame portion has a frame handle portion extending upward from the top of the frame portion, and a handle recess corresponding to the button operation portion of the main body.

In another embodiment, a multifunction vacuum cleaner for cleaning a surface according to the present invention comprises a nozzle assembly for drawing in air, including entrained dust or dirt, from the surface, a main body having a cyclone dust collector for centrifugally separating the dust or dirt from the air drawn into the cyclone dust collector, a dust receptacle for collecting the separated dust or dirt separated in the cyclone dust collector, a main body frame, a button operation portion including a connecting projection capable of moving together with the button operation portion, and a frame portion, pivotably connected with the nozzle assembly, having a connecting groove capable of receiving the connecting projection therein.

The button operation portion may further comprise an essentially semicircular button operation portion body, a biasing member for biasing the button operation portion toward a desired position, a pressing button integrally formed with the button operation portion body disposed at a top part thereof, and a guide extended from one side of the button operation portion.

BRIEF DESCRIPTION OF THE DRAWINGS

These and other features, aspects, and advantages of the present invention will become better understood when read with regard to the following description, appended claims, and accompanying drawings wherein:

DESCRIPTION OF THE PREFERRED EMBODIMENTS

Hereinafter, preferred embodiments of a cyclone type vacuum cleaner according to the present invention will be described in detail with reference to the accompanying drawings.

Figure 1:
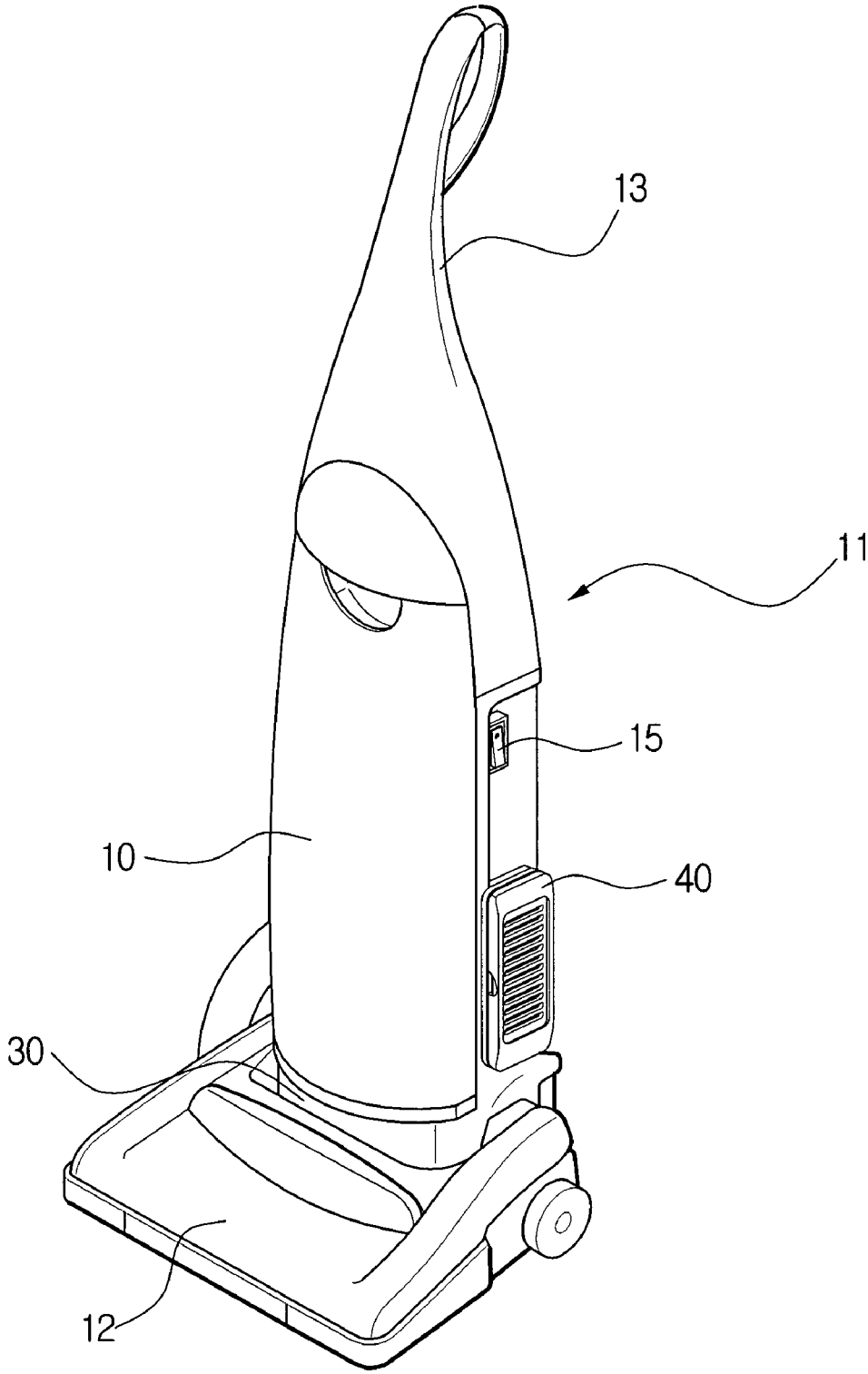
FIG. 1 (PRIOR ART)
FIG. 1 is a perspective view of a conventional upright vacuum cleaner.
Figure 2:
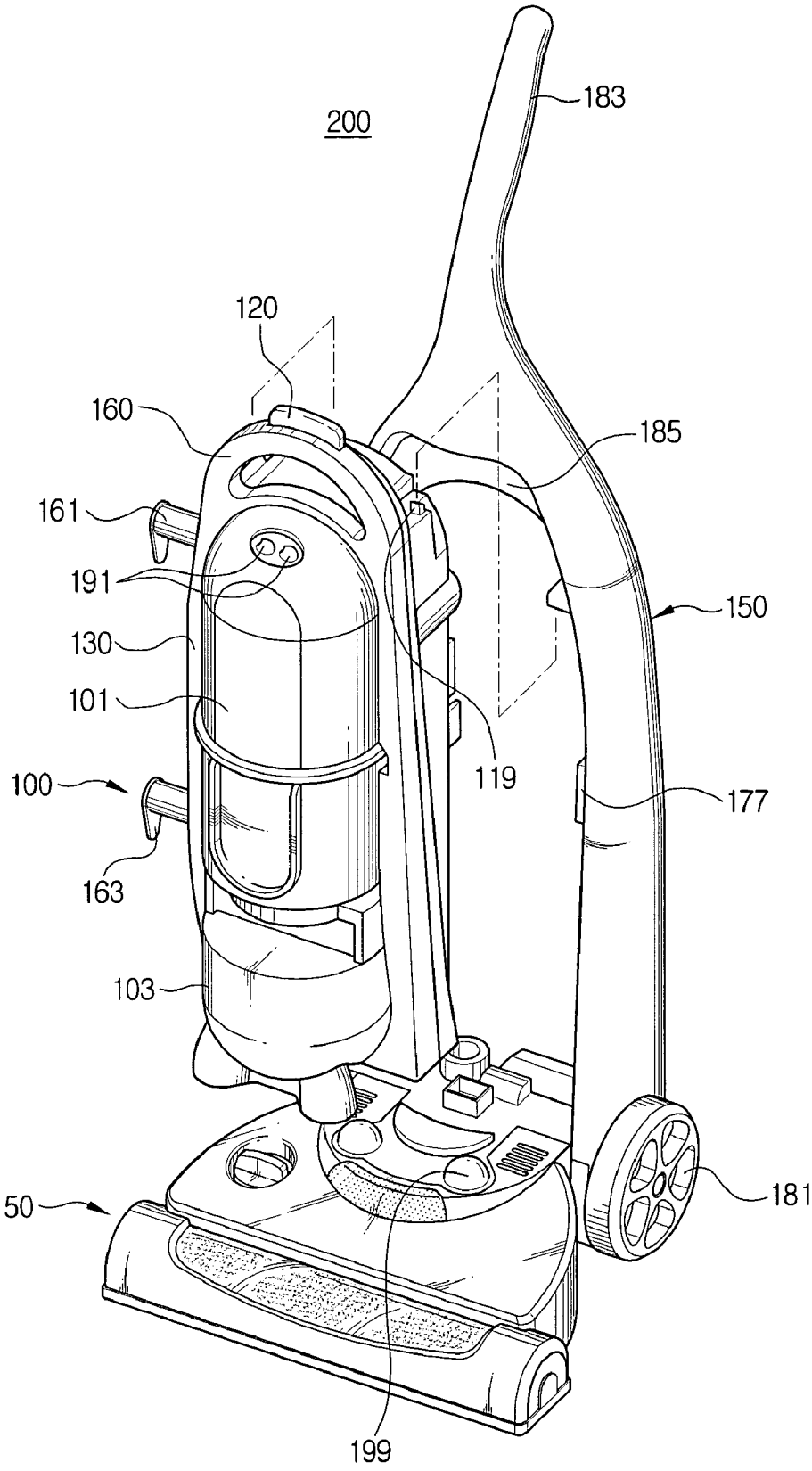
FIG. 2 is a perspective view showing the structure of a multifunction vacuum cleaner according to the present invention having a main body removable from a frame portion.

FIG. 2 is a perspective view showing the structure of a multifunction vacuum cleaner according to a preferred embodiment of the present invention having a main body removable from a frame portion.

Referring to FIG. 2, the vacuum cleaner comprises a nozzle assembly 50, a main body 100 fluidly communicating with the nozzle assembly 50, and a frame portion 150 which is pivotably connected with the nozzle assembly and capable of pivoting in relation to the nozzle assembly 50. The main body 100 is removably connected within the frame portion 150.

The nozzle assembly 50 has a suction port (not shown) in a bottom surface thereof for drawing in air and entrained dust therethrough, and a seating support 199 formed on the upper part for mounting of the main body 100 into the frame portion 150 in a secure manner.

The main body 100 comprises a main body frame 130, preferably surrounding the other elements of the main body, such as a cyclone dust collector 101 for centrifugally separating dust from the air drawn into the cyclone dust collector 101, and a dust receptacle 103, which is removable, for collecting the separated dust.

The cyclone dust collector 101 is a general dust collector which separates dust from the air by centrifugal force in a cyclone stream. The dust receptacle 103 is also a general dust receptacle for collecting the dust separated in the cyclone dust collector 101. Dust receptacle 103 is removable from the main body frame 130.

Figure 3:
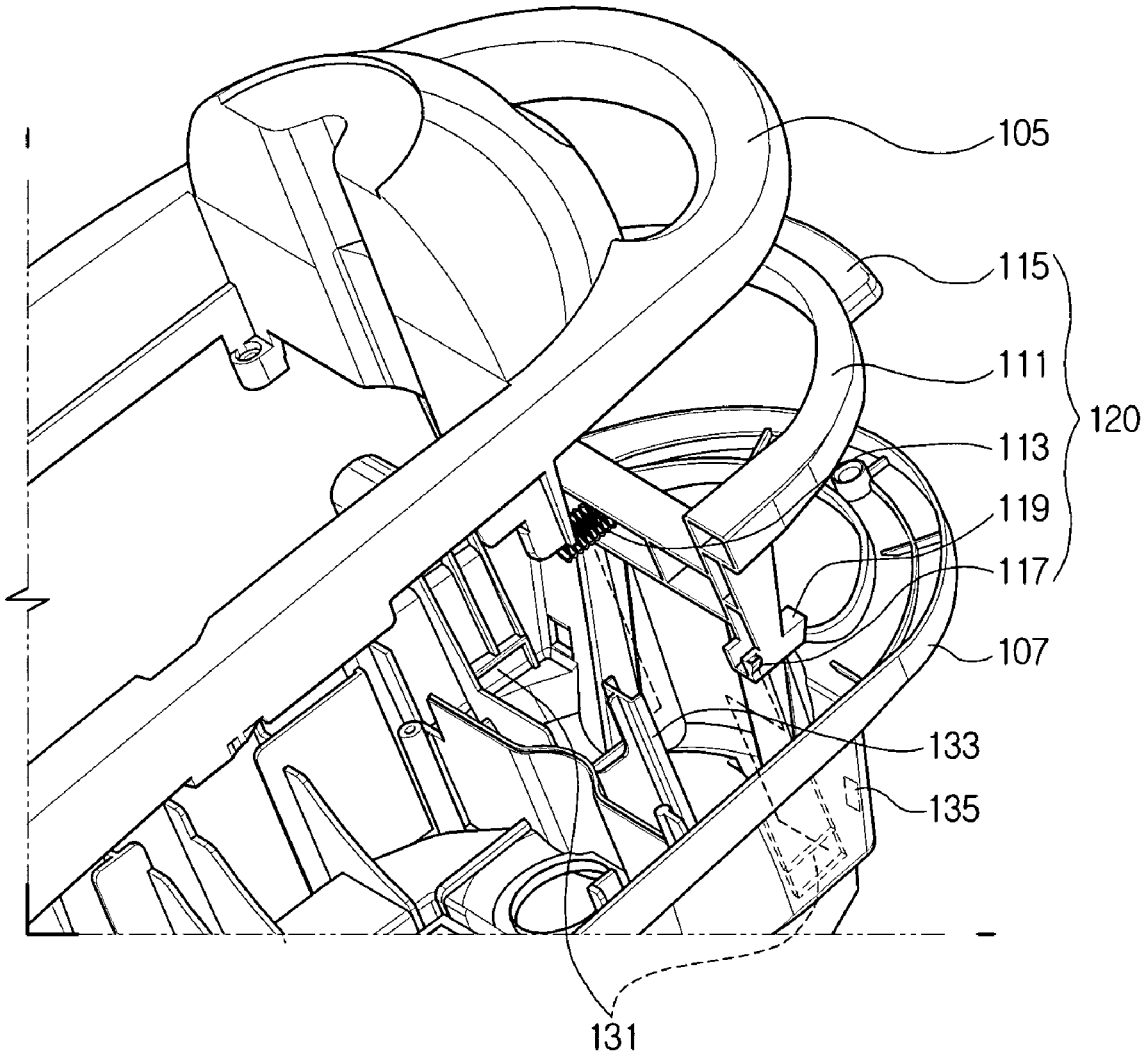
FIG. 3 is a partially exploded, perspective view of a button operation portion of the multifunction vacuum cleaner according to the present invention.

FIG. 3 is a partially exploded perspective view of a button operation portion 120 of the multifunction vacuum cleaner according to the present invention. As shown in FIGS. 2 and 3, the main body frame 130 comprises an upper casing 105, a lower casing 107 for connection to the upper casing 105, and the button operation portion 120 formed on an upper part of the main body frame 130 and sandwiched between the upper casing 105 and the lower casing 107.

The button operation portion 120 comprises a button operation portion body 111 which is semicircular, a biasing member 113 disposed to cooperate with the button operation portion body 111, a pressing button 115, preferably integrally formed with the button operation portion body 111 adjacent the top portion thereof, a guide 117 extended from one side of the button operation portion 120, and at least one connecting projection 119 integrally formed with the button operation portion 120, to move in conjunction with the button operation portion 120.

If the pressing button 115 of the button operation portion 120 is depressed, the connecting projection 119, which is integrally formed therewith, accordingly moves in a downward direction. Contrarily, if the pressing force is removed from the pressing button 115, the button operation portion 120 reverts to the initial position above the main body frame 130 by the recovery force of a biasing member 113. The biasing member 113 is preferably configured as a spring, such as a coil spring, as shown.

In addition, the main body frame 130 may comprise a biasing member supporting portion 133 for supporting the biasing member 113, a guide groove 131 for guiding movement of the guide 117, and an opening 135 for the connecting projection 119 to protrude therethrough.

Accordingly, by depressing the button 115 of the button operation portion 120, the button operation portion 120 moves as a whole within the main body 100 and is elastically biased to return to the normal position during operation of the vacuum cleaner.

Further, the main body 100 of the vacuum cleaner comprises a handle portion 160 (FIG. 2) permitting the user to grab the upper part of the main body 100. The handle portion 160 has a hollow portion therein shaped and configured to correspond to the button operation portion 120. Accordingly, the main body 100 is easily separated from the frame portion 150 by simply depressing the pressing button 115 of the button operation portion 120 as the user grabs the handle portion 160.

Figure 4A:
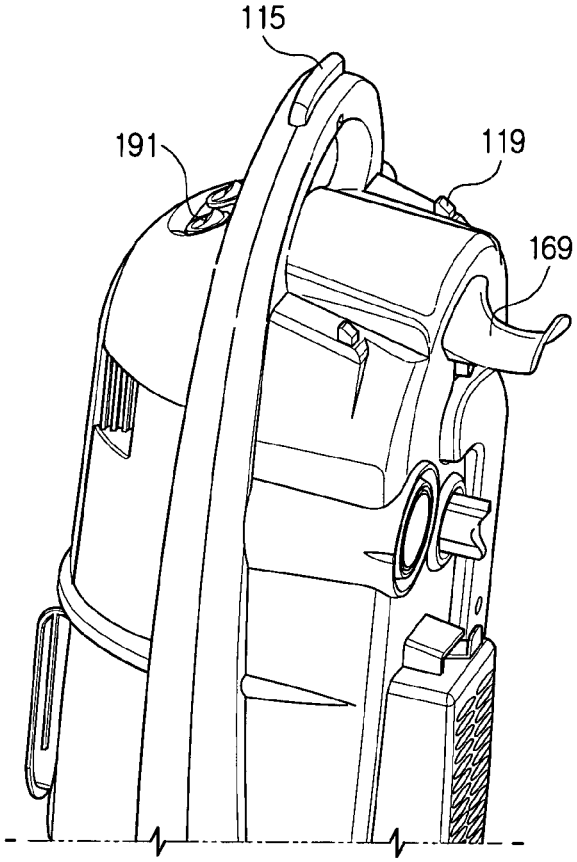
FIG. 4A is a perspective view showing a connecting projection of the main body
Figure 4B:
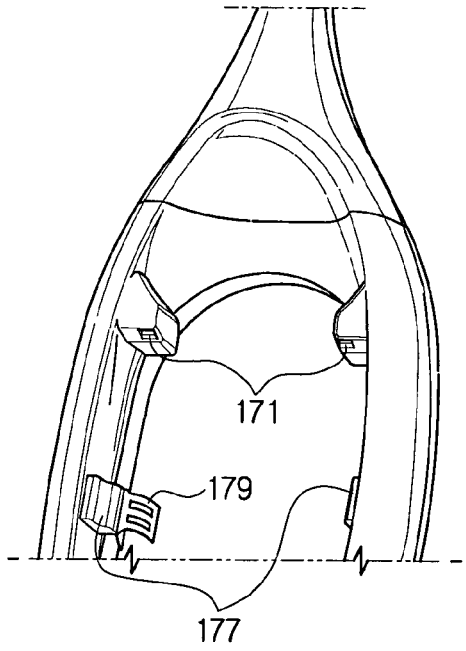
FIG. 4B is a perspective detail view of a connecting groove of a frame portion of the multifunction vacuum cleaner according to the present invention.
Figure 5:
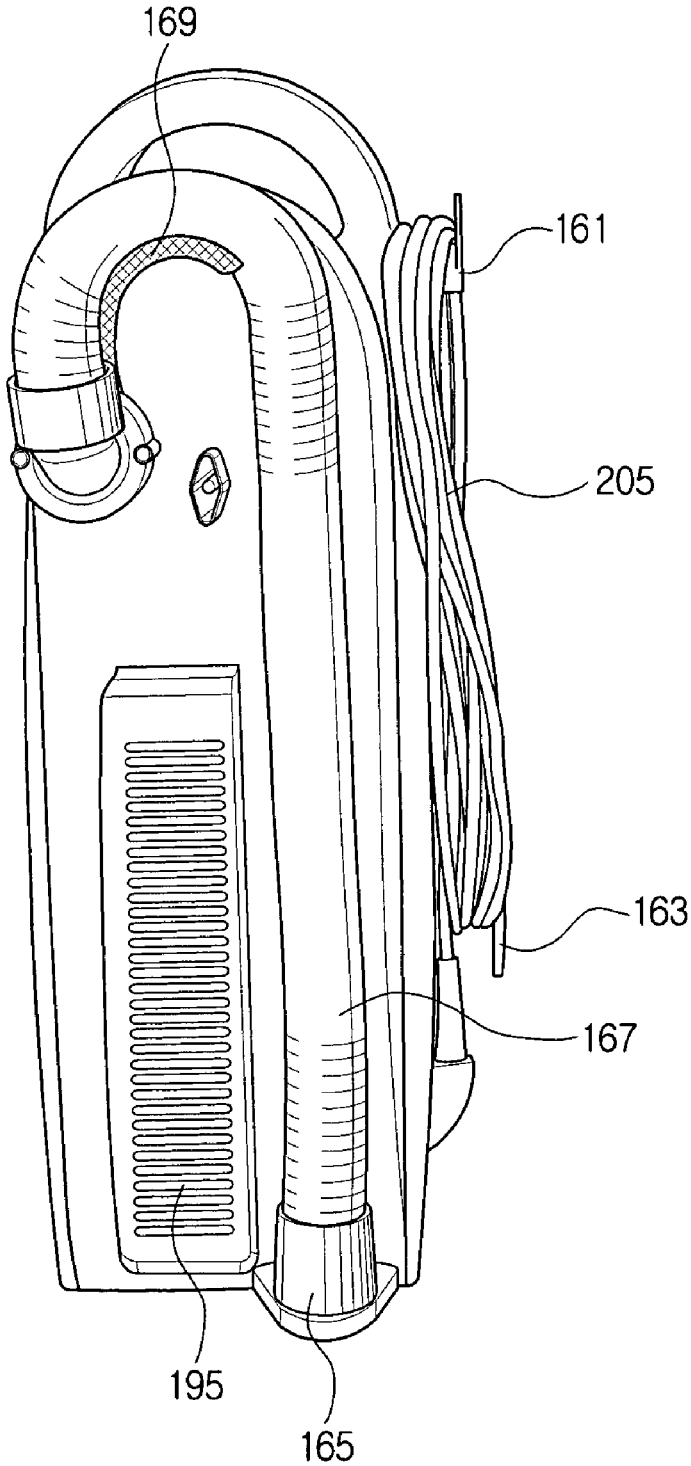
FIG. 5 is a rear view of the main body of the multifunction vacuum cleaner according to the present invention.

FIG. 4A is a perspective view showing a connecting projection of the main body and FIG. 4B is a detail perspective view of a connecting groove formed on a frame portion of the multifunction vacuum cleaner according to the present invention. FIG. 5 is a rear view of the main body of the multifunction vacuum cleaner according to the present invention.

Referring to FIGS. 4A, 4B and 5, on the main body 100 adjacent a flank thereof, a rotatable first cord holder 161 is provided for winding and holding a cord 205 of the vacuum cleaner 200 thereon, and a second cord holder 163, is disposed at a predetermined distance from the first cord holder 161.

With the first and second cord holders 161, 163, a user can retain the cord 205 attached to the main body 100 in a handy and compact manner.

A connecting member 165 fluidly communicating with the nozzle assembly 50 is formed at a bottom part of the main body 100. On the rear side of the main body 100 are formed a flexible hose 167 to be connected to the connecting member 165, a hose supporting member 169 to support the flexible hose 167, and a discharging grill 195 for discharging the air after it has been separated from dust and debris.

In using the main body 100 alone, when separated from the frame portion 150, an end of the flexible hose 167 can be separated from the connecting member 165 so as to permit attachment thereof to auxiliary brushes or other accessories.

Further, an on/off switch 191 is formed on a side of the main body 100 to enable the user to turn the vacuum cleaner on and off. Generally, the on/off switch is preferably formed on an upper part of a front side of the main body 100, as shown in FIG. 4A.

Referring to FIGS. 2, 4A and 4B, the frame portion 150 where the main body 100 is removably mounted will be described hereinafter.

Since at least one connecting groove 171 is formed on one side of the frame portion 150 to correspond to each connecting projection 119, the main body 100 can be removably mounted into the frame portion 150. It is preferable that respectively two connecting projections 119 and connecting projection grooves 171, correspondingly disposed to the connecting projections 119, are formed to connect securely to each other.

Additionally, supporters 177 are formed on both sides of the frame portion 150 to support the main body 100 after it is mounted within the frame portion 150.

A mounting guide 179 is formed on one side of the supporter 177 for mounting of the accessories of the vacuum cleaner thereon. Therefore, when the main body 100 is separated from the frame portion 150, because the auxiliary brushes or other accessories do not have to be connected on the main body 100, the main body 100 can be used without carrying the unnecessary weight of the auxiliary brushes or other accessories.

The connecting groove 171 may be partially slanted with respect to the frame portion 150 so that the main body 100 is easily connected with the frame portion 150 along the slant of the connecting projection groove 171. Further, on both sides of the bottom of the frame portion 150, wheels 181 are formed to permit the frame and vacuum cleaner to move along an area to be cleaned.

In addition, a frame handle portion 183 is formed extending upwardly from the top of the frame portion 150, and a handle recess 185, is formed in the frame portion 150 to correspond with the position of the button operation portion 120 of the main body 100. Due to the presence of the handle recess 185, the user can depress the button operation portion 120 more easily.

Hereinafter, the operation of the vacuum cleaner according to the present invention, in which the main body is removably mounted into the frame, will be described.

Through manipulation of the on/off switch 191, power is supplied to the vacuum cleaner. Accordingly, a motor (not shown) in the main body 100 is driven, subsequently generating a strong suction force at the nozzle assembly 50, which is fluidly communicated with the main body 100. By the suction force, dust and dirt located on the area to be cleaned is drawn through the suction port (not shown) of the nozzle assembly 50 and the flexible hose 169, and then to the main body 100.

The dust is centrifugally separated from the air drawn into and passing through the cyclone dust collector 101 of the main body 100. The filtered air is discharged through the discharging grill 195, which is on the rear side of the main body 100, as shown in FIG. 5.

The separated dust and dirt is collected in the dust receptacle 103 of the main body 100. When the collected dust fills the dust receptacle 103 to a predetermined amount, the user may separate the dust receptacle 103 to empty the dust receptacle 103 and then remount the dust receptacle into the main body 100.

For a narrow area to be cleaned or if there is an obstacle, such as a doorsill, in the way of the free movement of the nozzle 50, the user can separate the main body 100 from the frame portion 150 by depressing the button operation portion 120 of the handle portion 160 and thereby causing the at least one connecting projection 119, which is integrally formed with the button operation portion 120, to withdraw from the connecting groove 171 of the frame portion 150.

Then, the biasing member 113 disposed in the button operation portion 120 is compressed. The biasing member 113 returns the button operation portion 120 to the initial position automatically, after the main body 100 is separated form the frame portion 150.

When separating the main body 100 from the frame portion 150, the direction of separating the main body 100 and the direction of pressing the button operation portion 120 usually make a right angle. That is, the user can separate the main body 100 from the frame portion 150 by pulling the handle portion 160 in a direction perpendicular to the direction of pressing the button operation portion 120 and so remove the main body 100 to clean in a narrow space.

After separating the main body 100 from the frame portion 150, the user can separate an end of the flexible hose 167 from the connecting member 165 to enable the attachment of general auxiliary brushes or other accessories to clean a desired area, such as bedclothes or a narrow space.

After the cleaning work in the narrow space has been completed, the user reconnects the flexible hose 167 to the connecting member 165 of the main body 100, and connect the main body 100 to the frame portion 150 by taking the handle portion 160 and inserting the bottom thereof into the bottom part of the frame portion 150.

More specifically, as the main body 100 is pushed toward the frame portion 150, with its bottom part being affixed onto the seating portion 199, the connecting projection 119 of the button operation portion 120 is slid along the slanted surface of frame portion 150 and then hooked in the connecting groove 171 of the frame portion 150.

At this time, the biasing member 113 in the button operation portion 120 biases the connecting projection 119 toward the normal position, so that the button operation portion 120 is elastically connected into the connecting groove 171 of the frame portion 150. Further, the main body 100 is naturally connected to the frame portion 150 by gravity acting on the weight of the main body 100, and is securely fixed by the supporter 177.

As described hereinbefore, according to the present invention, when the area to be cleaned is narrow or there is a doorsill or other obstruction on the floor, the user can separate the main body 100 of the vacuum cleaner 200 from the frame portion 150 and so, use it more conveniently. Moreover, it is economical since the user does not have to purchase an additional smaller size vacuum cleaner.

Further, it is convenient to a user since the vacuum cleaner according to the present invention can be used depending on the user's choice such as whether the user will use the vacuum cleaner with the main body 100 being connected to the frame portion 150 or being separated from the frame portion 150.

In addition, the main body 100 can be separated easily by the button operation portion 120 located on the top of the main body 100 of the vacuum cleaner, and can be easily connected due to its own weight. Also, the vacuum cleaner according to the present invention has a more rigid structure. Accordingly, the user can connect or separate the main body 100 of the vacuum cleaner 200 easily.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A multifunction vacuum cleaner comprising:

a nozzle assembly for drawing in air, including entrained dust or dirt, from an area to be cleaned;

a main body having a cyclone dust collector for centrifugally separating the dust or dirt from the air drawn into the cyclone dust collector, a dust receptacle for collecting the separated dust or dirt separated in the cyclone dust collector, a main body frame having an upper casing and a lower casing, a button operation portion formed on an upper part of the main body frame, and first and second connecting projections that are integrally formed with the button operation portion and which extend through corresponding first and second openings in the main body, the first and second connecting projections, moving downwardly and into the main body by depressing the button operation portion to enable the main body to be detached from a frame portion, a motor within the main body generating a suction at the nozzle assembly; and a frame portion, sized, shaped and arranged to received said main body therein, the frame portion being pivotably connected with the nozzle assembly, and having first and second connecting grooves formed in the frame portion such that the first and second connecting grooves are spaced apart from each other and proximate to opposing sides of the frame portion, the first and second connecting moves being sized, shaped and arranged to receive the first and second connecting projections therein when the button operation portion is not depressed; and wherein said main body is detachable from the frame portion by operation of the button operation portion, said main body being operable and capable of drawing dust and dirt into the cyclone dust collector when the main body is detached from the frame portion; and wherein the button operation portion further comprises:

a button operation portion body which is semicircular;

a biasing member for biasing the button operation portion body toward a desired position whereat the first and second connecting projection engage the first and second connecting grooves when the main body is within the frame portion;

a pressing button integrally formed with the button operation portion body at a top part thereof; and a guide extended from one side of the button operation portion.

2. The multifunction vacuum cleaner of claim 1, wherein the main body frame comprises a biasing member supporting portion for supporting the biasing member, a guide groove for guiding movement of the guide, and an opening through which the connecting projection protrudes, whereby the button operation portion moves in the main body as the pressing button of the button operation portion is depressed.

3. The multifunction vacuum cleaner of claim 1, the main body comprises a handle portion to permit a user to grab on the upper part.

4. The multifunction vacuum cleaner of claim 3, the handle portion is shaped to corresponding to the shape of the button operation portion and includes a hollow recess therein.

5. The multifunction vacuum cleaner of claim 1, wherein the main body further comprises on one side thereof:

a rotatable first cord holder for winding therearound and holding a power cord of the vacuum cleaner; and a stationary second cord holder formed at a predetermined distance from the first cord holder.

6. The multifunction vacuum cleaner of claim 1, wherein the main body further comprises a communicating member disposed at a bottom part of the main body for fluidly communicating with the nozzle assembly.

7. The multifunction vacuum cleaner of claim 6, wherein the main body includes a rear portion, and further comprises:

a flexible hose capable of being connected to the communicating member;

a hose supporting member for supporting the flexible hose; and a discharging grill through which clean air is discharged.

8. The multifunction vacuum cleaner of claim 7, wherein the flexible hose is removably connected to the communicating member, and when removed, capable of being connected with an auxiliary accessory on one end thereof.

9. The multifunction vacuum cleaner of claim 1, wherein the main body further comprises an on/off switch located at a front side of the main body.

10. The multifunction vacuum cleaner of claim 1, wherein the frame portion further includes at least one supporter formed on at least one side thereof to provide support for the main body when it is mounted therein.

11. The multifunction vacuum cleaner of claim 10, wherein each supporter has a mounting guide on one side of the supporter for the mounting of accessories for use with the vacuum cleaner.

12. The multifunction vacuum cleaner of claim 1, wherein each connecting groove further includes a slanted part for easier insertion of the main body into the frame portion.

13. The multifunction vacuum cleaner of claim 1, wherein the frame portion further comprises wheels on both sides of the bottom thereof to permit easier motion of the vacuum cleaner over the area to be cleaned.

14. The multifunction vacuum cleaner of claim 1, wherein the frame portion has a frame handle portion extending upwardly from the top of the frame portion, and a handle recess corresponding to the button operation portion of the main body.

15. A multifunction vacuum cleaner for cleaning a surface comprising:

a nozzle assembly for drawing in air, including entrained dust or dirt, from the surface;

a main body having: a motor that draws dust and dirt into a cyclone dust collector in the main body and which centrifugally separates the dust or dirt from the air drawn into the cyclone dust collector, a dust receptacle for collecting the separated dust or dirt separated in the cyclone dust collector, a main body frame, first and second connecting projections that are integrally formed with the button operation portion and which extend through corresponding first and second openings in the main body to engage corresponding first and second connecting grooves formed in a frame portion, the first and second connecting projections, and a button operation portion; and a frame portion, pivotably connected with the nozzle assembly, and having first and second connecting grooves, receiving the first and second connecting projections therein;

wherein the nozzle assembly includes a pair of hemispherical seating portions that engage a bottom part of the main body; and wherein the main body is detachable from the frame portion by operating the button operation portion and is capable of drawing dirt and dust into the dust collector after the main body is detached from the frame portion; and wherein the button operation portion further comprises:

an essentially semicircular button operation portion body;

a biasing member for biasing the button operation portion toward a desired position;

a pressing button integrally formed with the button operation portion body disposed at a top part thereof; and a guide extended from one side of the button operation portion.

* * * * *